US005380966A

United States Patent [19]

Liu

[11] Patent Number: 5,380,966

[45] Date of Patent: Jan. 10, 1995

[54] HOUSING FOR ACCOMMODATING AN ALARM CONDUCTING CLIPPER

[76] Inventor: Hung-Chang Liu, No. 1, Lane 56, Sec. 2, Ta Cheng Rd., Tainan City, Taiwan, Prov. of China

[21] Appl. No.: 219,471

[22] Filed: Mar. 29, 1994

[51] Int. Cl.[6] ..... H01H 1/06

[52] U.S. Cl. ..... 200/283; 200/6 C; 200/239; 200/329; 200/322

[58] Field of Search ..... 200/6 B, 6 C, 61.93, 200/502, 239, 245, 275, 283, 329, 321, 322

[56] References Cited

U.S. PATENT DOCUMENTS

| | | | |
|---|---|---|---|
| 3,573,408 | 4/1971 | Farrell | 200/283 X |
| 3,622,729 | 11/1971 | Ohno | 200/283 X |
| 3,999,024 | 2/1977 | Manquandt | 200/6 B X |
| 4,007,348 | 2/1977 | Van Son et al. | 200/283 |
| 4,010,339 | 3/1977 | Owen et al. | 200/392 |
| 4,453,060 | 6/1984 | Kim | 200/283 X |
| 5,013,877 | 5/1991 | Jervis | 200/321 X |
| 5,199,554 | 4/1993 | Kano et al. | 200/283 |

*Primary Examiner*—Ernest G. Cusick

*Attorney, Agent, or Firm*—Morton J. Rosenberg; David I. Klein

[57] ABSTRACT

A housing to accommodate an alarm conducting clip is made of electrically insulating material having a small aperture at one end for an electric cord passing therethrough, a large aperture at opposite end having a passage formed in-between the apertures adapted to receive a pair of copper plates at inner top and bottom portions, respectively, and a pair of slanting slots at respective walls adapted to receive an actuated rod which is adapted to press a clip to close or to open at its free ends. The clip is formed in a V-shaped profile having the closed end inserted into the housing through the large aperture with the opposite free ends protruding therefrom. The constantly open free ends engage the two copper plates, respectively, that forms a closed circuit of the alarm. The free ends will be forced to close by the activating rod and thus disengage from the two copper plates and forming an open circuit of the alarm, thereafter.

1 Claim, 6 Drawing Sheets

HOUSING FOR ACCOMMODATING AN ALARM CONDUCTING CLIPPER

FIELD OF THE INVENTION

This invention relates to a housing for accommodating an alarm conducting clipper and more particularly to a housing which is self-disengagable to deactivate the alarm.

BACKGROUND OF THE PRIOR ART

Owing to the security of our society becomes worse than before, many people have prepared alarms or dazzling guns to defense themselves from being attacked. The dazzling guns is too aggresive and may hurt themself or children, accidentally. Therefore, alarm is considered a better device to protect people.

However, the present alarm on market, as shown in FIGS. 5A, and 6, composes of an alarm A having a socket A1 adapted to receive a cord B1 therein, an insulating housing B, and an insulating sleeve B3. The cord B1 is connected to one end of an electric wire B12, the other end of the wire B12 is connected pair of copper plates B11, respectively, which are located in the housing B. The clip B2 is made of a piece of elastic material in V-shaped profile, having its joint end inserted in the housing B, while the free ends of the clip B2 protrude therefrom. The clip B2 functions as a switch to activate the alarm A when the free ends are in open status, or deactivate the alarm when the free ends of the clip B2 are sealed in closed status by the sleeve B3, as shown in FIG. 5B.

However, the sleeve B3 is a separate item from the alarm itself that is very inconvenient to use.

The inventor, in view of this, has invented the present invention which utilizes an actuating rod to activate or to deactivate the alarm.

SUMMARY OF THE INVENTION

It is the primary object of the present invention to provide a housing for accommodating an alarm conducting clip which includes an actuating rod on the housing adapted to control a clip either in open or in closed status.

It is another object of the present invention to provide a housing for accommodating an alarm conducting clip which is easy to operate.

It is a further object of the present invention to provide a housing for accommodating an alarm conducting clip which corresponds to the principle of cost effectiveness.

DETAILED DESCRIPTION OF THE PREFERRED EMBODIMENT

Figure 1:
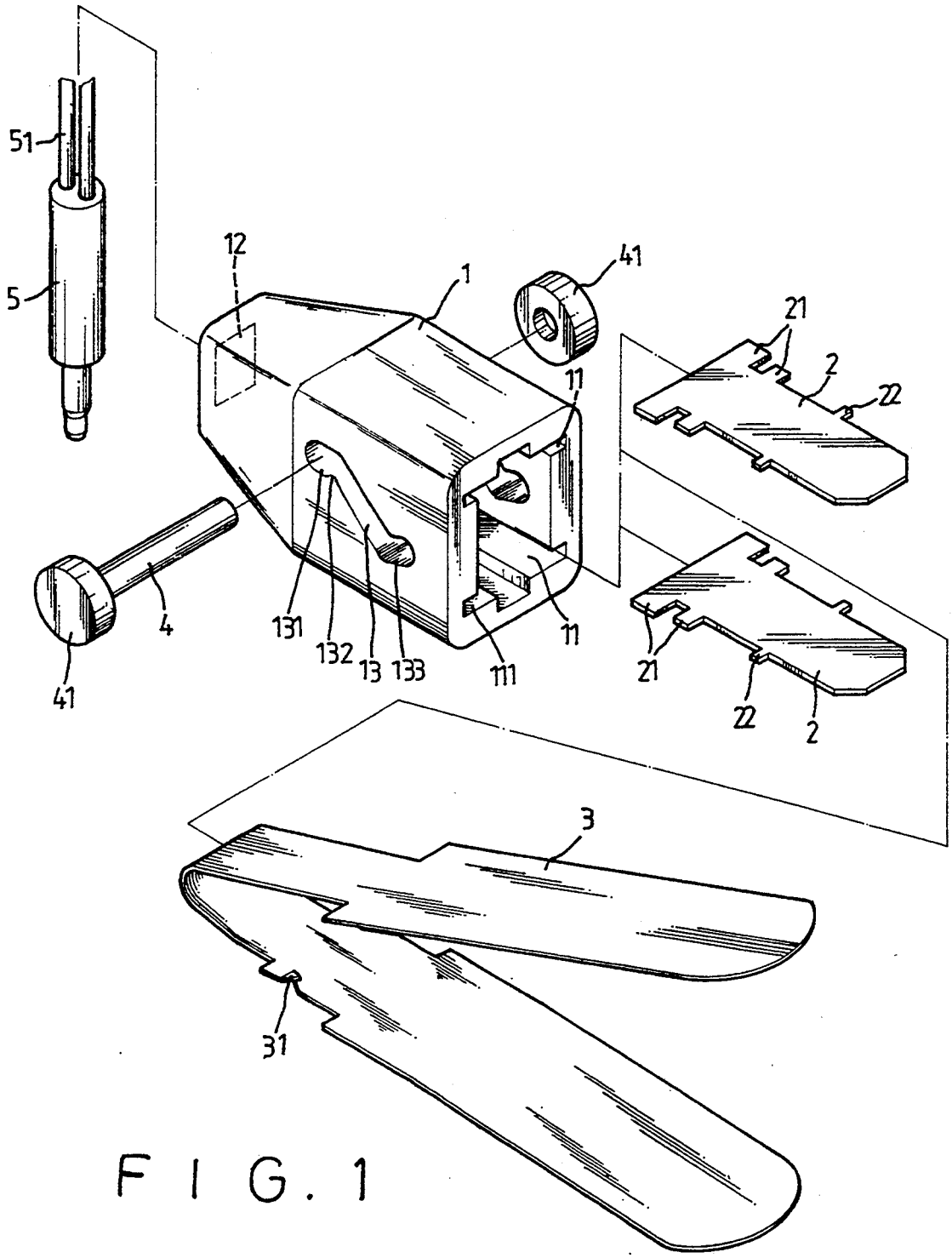
FIG. 1 is a fragmentary view of the present invention.

Referring now to the drawings wherein the showings are for the purpose of illustrating a preferred embodiment only and not for the purpose of limiting the same, FIG. 1 shows the present invention which comprises a housing 1 which is made of electrically insulating material, a pair of identical copper plates 2, and a clip 3 which is of V-shaped profile lodged therein. An actuating rod 4 slidably along a pair of slanting slots 13.

The housing 1 includes a large aperture 11 at one end, a small aperture 12 at the opposite end, and a pair of slanting slots 13 at respective walls and corresponding to each other. In the interior of the housing 1 there is formed a passage along the axis and a pair of troughs 111 at the upper and lower portions of the large aperture 11 adapted to receive the copper plates 2, respectively. Each slanting slot 13 includes a pair of horizontal troughs 131, 133 extending from the top and the bottom ends of the slots 13, respectively, adapted for the actuating rod 4 to rest therein. A pair of protuberances 132 are formed at the top horizontal troughs 131 of the slots 13, respectively, adapted to prevent the actuating rod 4 from sliding in the slot 13 downwardly from the top horizontal trough 131. The bottom horizontal trough 133 of each slot 13 has slightly arisen from the end connected to the slot 13 toward the far end so as to prevent the actuating rod 4 from sliding upwardly in the slot 13.

Each copper plate 2 includes a pair of curling edges 21 at respective sides of one end adapted to connect to one end of an electric wire 51. The other end of the wire 51 extends outwardly from the small aperture 12 and having connected to a cord 5. A pair of protuberances 22 at respective sides of center portion of the copper plates 2 adapted to hold the copper plate 2 in the trough 111 of the housing 1, securely.

The clip 3 is made of elastic material and is bent to form a V-shaped profile having a pair of ratchet teeth 31 at lower piece of the clip 3 adapted to hold the clip 3 securely in the housing 1.

The actuating rod 4 located in the slanting slots 13 in a slidable manner, includes a pair of enlarged portions 41 at respective ends adapted to prevent the rod 4 from disengaged from the slots 13 and also for the purpose of easy operation in rolling the rod 4 within the slots 13.

Figure 2:
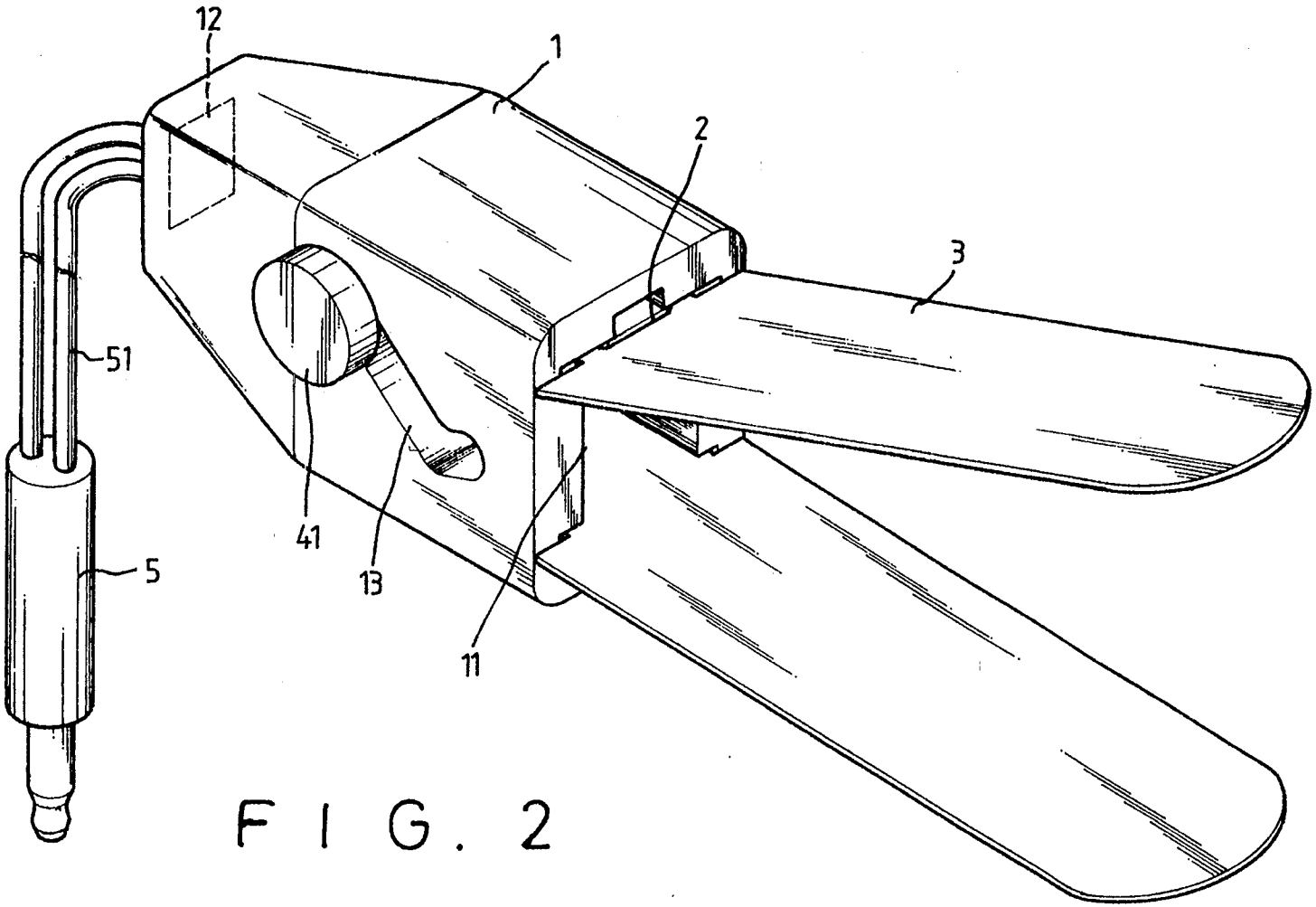
FIG. 2 is a perspective view of FIG. 1.
Figure 3:
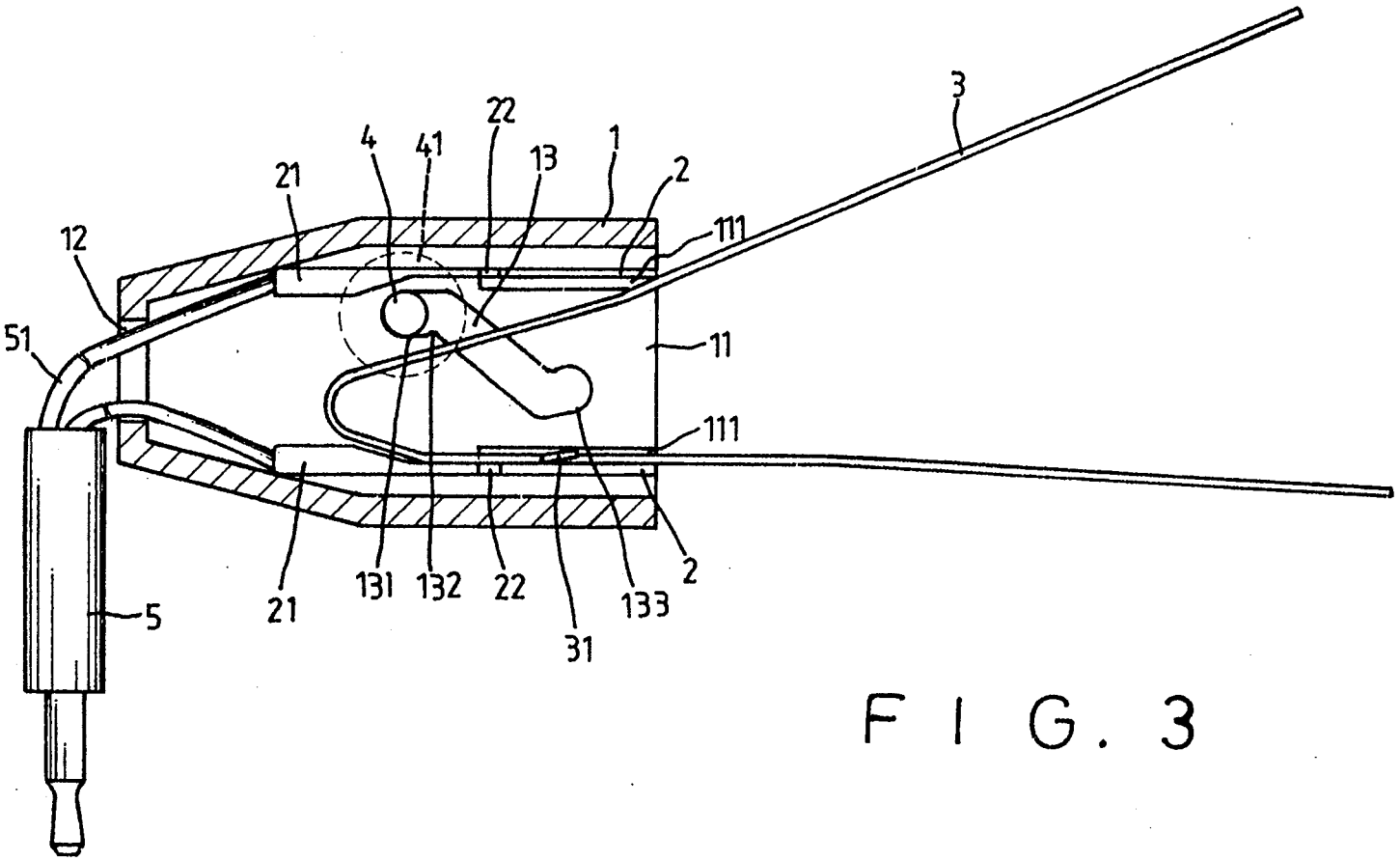
FIG. 3 is a side sectional view of FIG. 2, showing the alarm in an activating status.
Figure 4:
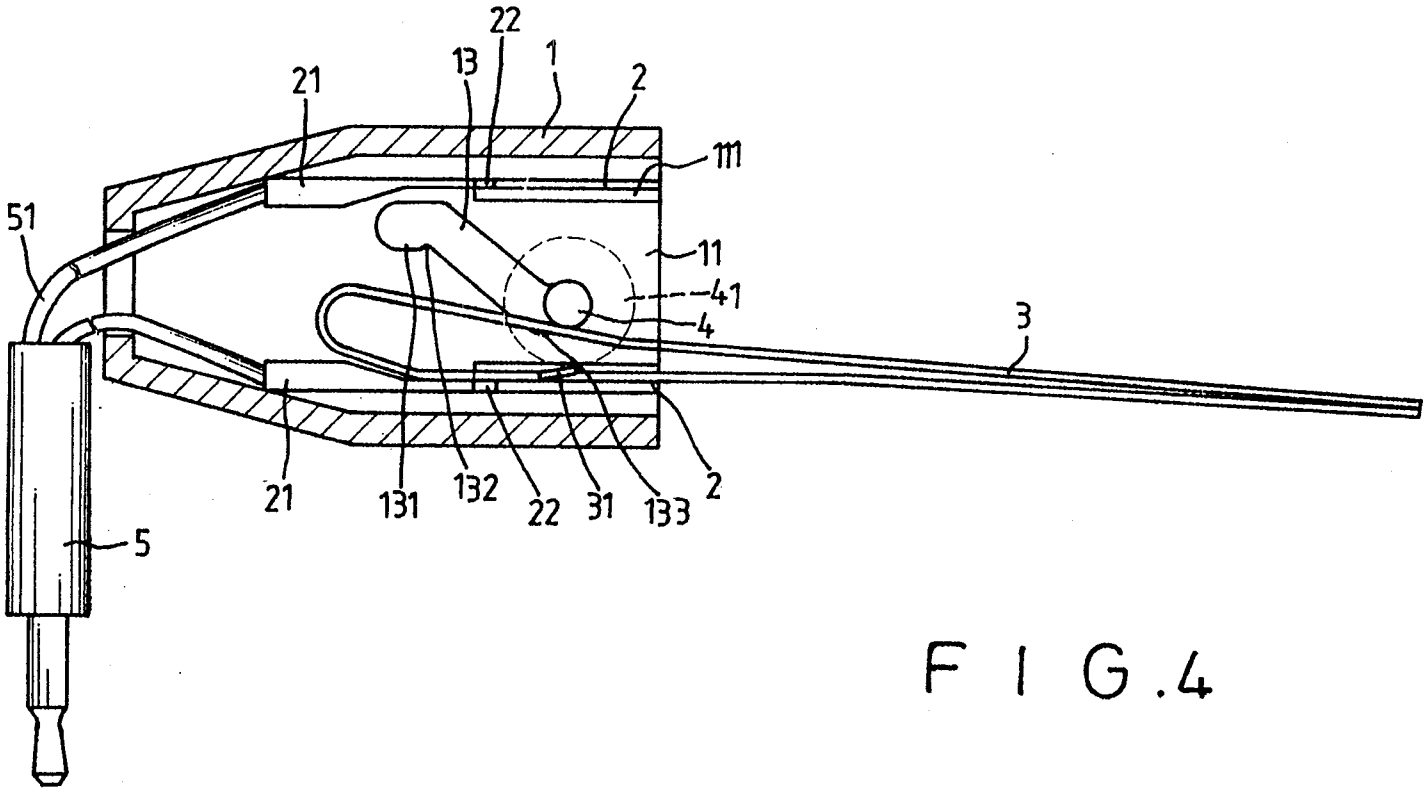
FIG. 4 is a view like FIG. 3 but showing the alarm in a deactivated status.
Figure 5A:
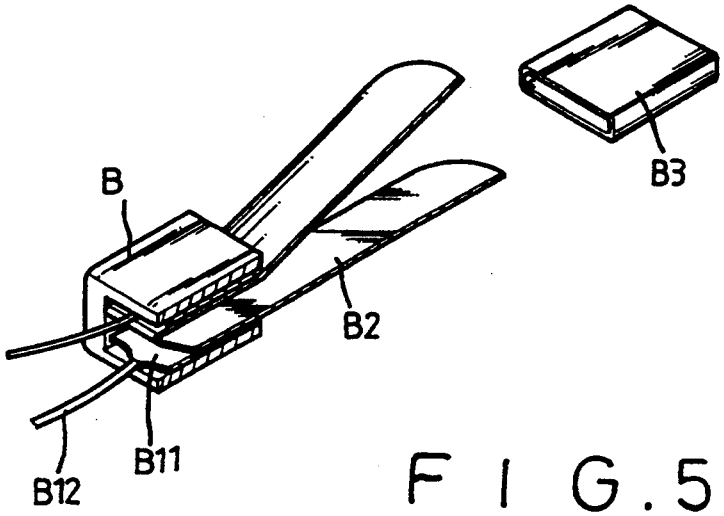
FIG. 5A (PRIOR ART)
FIG. 5A is a sectioned fragmentary view of a prior art, showing the alarm in an activated status.
Figure 5B:
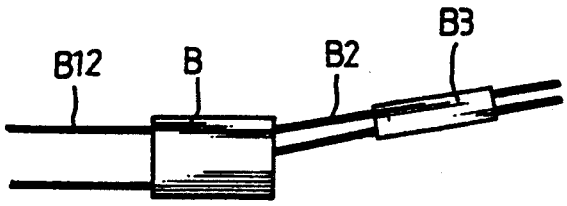
FIG. 5B (PRIOR ART)
FIG. 5B is a side view of FIG. 5A, showing the alarm in a deactivated status.
Figure 6:
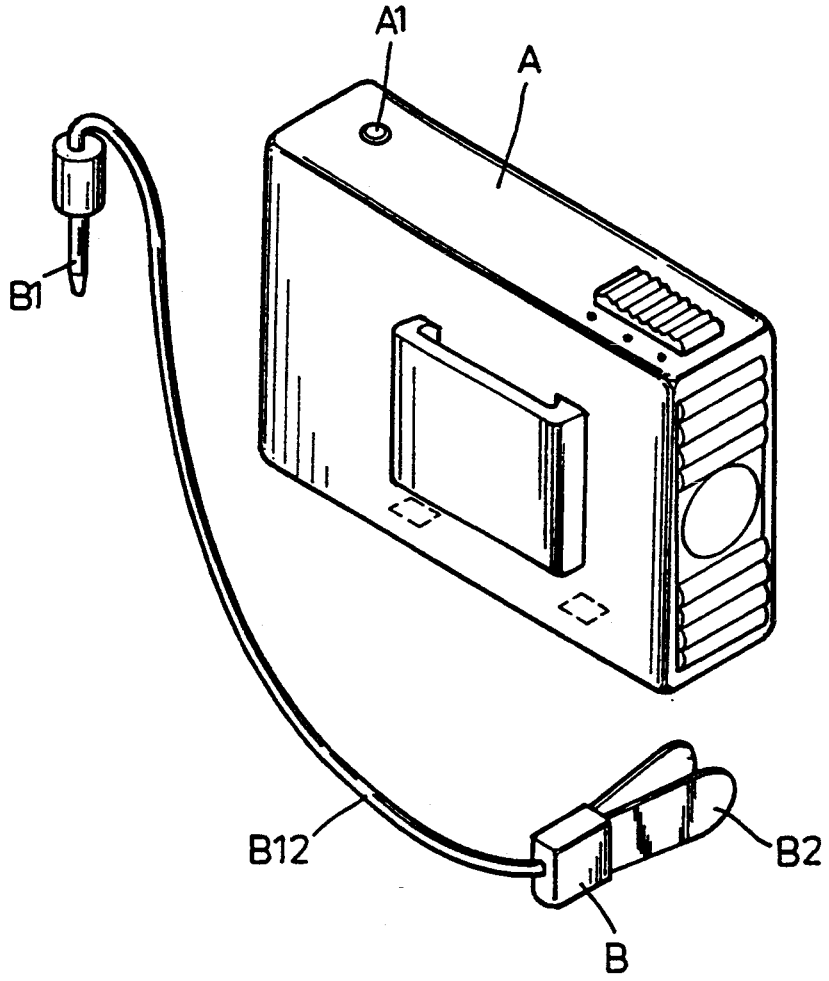
FIG. 6 (PRIOR ART)
FIG. 6 is perspective view of the prior art connected to an alarm in an activated status.

To assemble the present invention, initially, insert the two copper plates 2 into the troughs 111 in the top and the bottom portions of the large aperture 11 and connect one end of the electric wire 51 to the curling edges 21, respectively, then insert the clip 3 into the passage of the housing 1 with the two free ends protruding outwardly, and finally insert the actuating rod 4 into the slots 13 and rests in the top trough 131, as shown in FIG. 2. The free ends of the clip 3 includes an upper and a lower pieces with the upper piece engaging with one copper plate 2 at top trough 111 of the housing 1 and the lower piece of the clip 3 engaging with the other copper plate 2 located at the bottom trough 111 of the housing 1. This cause the alarm activated, as shown in FIG. 3. The actuating rod 4, at this moment, is located in the top horizontal trough 131. Upon the actuating rod 4 is rolled downwardly along the slots 13, and rests in the bottom trough 133 of the slot 13, the upper piece of the clip 3 will be pressed downwardly, as shown in FIG. 4, which brings the upper piece of the clip 3 to disengage the top copper plate 2 and forms an open circuit thereafter which deactivates the alarm, simultaneously.

I claim:

1. A housing for accommodating an alarm conducting clip comprising an electrically insulating housing, a pair of copper plates, an elastic V-shaped clip, an actuating rod, and a cord, and the improvement comprising:

said housing having a small aperture at one end, a large aperture at the opposite end having formed a passage therein along an axis of the housing, and a pair of slots at respective walls of the housing slanting from a top portion at one side downward to the bottom portion at the other side thereof, said slots having a pair of horizontal troughs with one extending from the top end of said slot and a protuberance thereat, the other horizontal trough extending from the bottom end thereof having arisen slightly upwardly at the endmost;

each of said copper plates having a pair of protuberances at respective sides thereof;

said clip having a V-shaped profile defining a top piece and a lower piece, and having a pair of ratchet teeth at respective sides of said lower piece thereof, said clip being inserted into said housing from said large aperture with the top piece slanting toward one direction opposite the slanting direction of said slots, the inserting end of said clip having extending beyond said slanting slots with the top piece located immediately underneath the top portion of said slots, and whereas the top piece being engaged with one of said copper plates located in the top portion of said housing, and whereas the lower piece of said clip being engaged with the other copper plate located in the bottom of said housing;

said actuating rod slidably resting on top of said slanting slots having a pair of enlarged portions at respective ends thereof.

* * * * *